US010456796B2

(12) United States Patent
Kim et al.

(10) Patent No.: US 10,456,796 B2
(45) Date of Patent: Oct. 29, 2019

(54) SPRAY NOZZLE FOR ATTEMPERATORS AND ATTEMPERATOR INCLUDING THE SAME

(71) Applicant: DOOSAN HEAVY INDUSTRIES & CONSTRUCTION CO., LTD., Gyeongsangnam-do (KR)

(72) Inventors: Dong Wook Kim, Gyeongsangnam-do (KR); Kyu Man Kim, Busan (KR); Woo Seong Song, Gyeongsangnam-do (KR); Jae Cheol Kim, Busan (KR); Cheol Hong Kim, Gyeonggi-do (KR); Tae Jun Yun, Gyeonggi-do (KR); Seong Yong Jeong, Gyeongsangnam-do (KR)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 31 days.

(21) Appl. No.: 15/461,342

(22) Filed: Mar. 16, 2017

(65) Prior Publication Data

US 2017/0363286 A1 Dec. 21, 2017

(30) Foreign Application Priority Data

Jun. 21, 2016 (KR) ..... 10-2016-0077104
Jun. 21, 2016 (KR) ..... 10-2016-0077109

(51) Int. Cl.
*F22G 5/12* (2006.01)
*B05B 7/00* (2006.01)
(Continued)

(52) U.S. Cl.
CPC ..... *B05B 7/0075* (2013.01); *B05B 15/65* (2018.02); *F22G 5/123* (2013.01); *B05B 1/205* (2013.01); *B05B 15/14* (2018.02)

(58) Field of Classification Search
CPC ..... F22G 5/12
See application file for complete search history.

(56) References Cited

U.S. PATENT DOCUMENTS 2,421,761 A * 6/1947 Rowand ..... F22G 5/12 122/479.1
4,442,047 A * 4/1984 Johnson ..... B01F 5/045 137/897

(Continued)

FOREIGN PATENT DOCUMENTS

JP 62-198309 U1 12/1987
JP H03286904 A 12/1991

(Continued)

OTHER PUBLICATIONS

An extended European search report issued by the European Patent Office dated Jan. 25, 2018 in connection with European patent application No. 17167881.6.

(Continued)

*Primary Examiner* — Nathaniel Herzfeld
(74) *Attorney, Agent, or Firm* — INVENSTONE Patent, LLC

(57) ABSTRACT

Disclosed herein are a spray nozzle for an attemperator and an attemperator including the spray nozzle. An attemperator according to an embodiment includes: a steam transfer pipe through which steam is transferred; a fixed pipe which is fixed to an outer surface of the steam transfer pipe; and a spray nozzle, which is coupled to the fixed pipe, disposed in the steam transfer pipe and configured to spray cooling water into the steam transfer pipe. The spray nozzle includes, on an outer circumferential surface thereof, at least one support that protrudes toward the fixed pipe. The spray nozzle is spaced apart from the fixed pipe.

17 Claims, 20 Drawing Sheets

(51) Int. Cl.

| | |
|---|---|
| ***B05B 15/65*** | (2018.01) |
| *B05B 1/20* | (2006.01) |
| *B05B 15/14* | (2018.01) |

(56) References Cited

U.S. PATENT DOCUMENTS

| | | | | |
|---|---|---|---|---|
| 5,041,246 | A * | 8/1991 | Garrison | B01F 3/04049 261/118 |
| 5,290,486 | A * | 3/1994 | Enarson | B01F 5/045 239/471 |
| 5,607,626 | A * | 3/1997 | Kunkle | F22G 5/123 261/116 |
| 6,746,001 | B1 | 6/2004 | Sherikar | |
| 8,469,341 | B2 * | 6/2013 | Ristau | F28C 3/08 261/62 |
| 8,955,773 | B2 * | 2/2015 | Watson | F22G 5/123 137/542 |

FOREIGN PATENT DOCUMENTS

| | | | |
|---|---|---|---|
| JP | 06-214496 | A | 8/1994 |
| JP | H0828809 | A | 2/1996 |
| JP | 09-273710 | A | 10/1997 |
| JP | 2003-287202 | A | 10/2003 |
| JP | 2004-020152 | A | 1/2004 |
| KR | 10-1581769 | B1 | 12/2015 |
| RU | 2206822 | C1 | 6/2003 |

OTHER PUBLICATIONS

Korean Office Action dated Aug. 21, 2017 in corresponding Korean patent application 10-2016-0077104.

Korean Office Action dated Aug. 21, 2017 in corresponding Korean patent application 10-2016-0077109.

* cited by examiner

Prior Art

SPRAY NOZZLE FOR ATTEMPERATORS AND ATTEMPERATOR INCLUDING THE SAME

CROSS-REFERENCE TO RELATED APPLICATION(S)

This application claims priority to Korean Patent Application Nos. 10-2016-0077104 filed on Jun. 21, 2016 and 10-2016-0077109 filed on Jun. 21, 2016, the disclosures of each of which are incorporated herein by reference in their entirety.

BACKGROUND

Exemplary embodiments of the present disclosure relate to a spray nozzle for an attemperator and an attemperator including the same, and more particularly, a cooling water spray nozzle which is provided in equipment such as a steam boiler of a thermal power plant that uses high-temperature steam, and reduces or prevents high-temperature steam from being overheated and controls the temperature of the steam.

Generally, a boiler for power generation is provided with a superheater for generating high-temperature steam needed for a turbine. Steam generated from the superheater is supplied to the turbine through a steam transfer pipe. An attemperator is installed on the steam transfer pipe so as to control the temperature of supplied steam to a temperature required in the turbine.

FIG. 1 is a conceptual diagram of an attemperator 100.

The attemperator 100 is installed outside the steam transfer pipe 200 through which high-temperature steam is transferred. The attemperator 100 includes a fixed pipe 20 which is installed outside the steam transfer pipe 200 and a spray nozzle 10, which is supported on the fixed pipe 20 and inserted into the steam transfer pipe 200.

The spray nozzle 10 is fixed by the fixed pipe 20 and a first weld 101. The fixed pipe 20, into and to which the spray nozzle 10 is inserted and fixed, is fixed to the outer circumferential surface of the steam transfer pipe 200 by a second weld 102.

In the spray nozzle installed in the above-mentioned manner, vibration is generated by high-temperature and high-pressure steam flowing through the steam transfer pipe, and there is a problem in that a coupling portion of the spray nozzle may be damaged by a resonance phenomenon caused when the frequency of vortex shedding of steam that is generated around the spray nozzle matches the natural frequency of the spray nozzle.

In an effort to overcome this problem, a technique may be employed in which a diaphragm 30 is attached on the outer surface of the spray nozzle. The diaphragm 30 has elasticity and is interposed between the spray nozzle and the fixed pipe, thus mitigating vibrations of the spray nozzle. The diaphragm 30 is fixed to the outer surface of the spray nozzle by a third weld 103.

The spray nozzle having the diaphragm is assembled with the fixed pipe in such a way that the spray nozzle is force-fitted into the fixed pipe, whereby the diaphragm is supported in the spray nozzle and the fixed pipe with sufficient strength. Thereby, the diaphragm increases the natural frequency of the spray nozzle, thus mitigating vibration of the spray nozzle.

However, in the spray nozzle having the above-mentioned shape, there is high probability of thermal deformation in the spray nozzle during a process of attaching the diaphragm to the spray nozzle by welding, and there is also high probability of a defect occurring during the force-fitting operation. Furthermore, there are problems in that it is not easy to separate the conventional spray nozzle from the fixed pipe, and it is difficult to reuse the fixed pipe and the spray nozzle.

BRIEF SUMMARY

An object of the present disclosure is to provide a spray nozzle for an attemperator which has a simple assembly structure and effectively mitigates vibration of the spray nozzle.

Another object of the present disclosure is to provide an attemperator including the spray nozzle having the above-mentioned characteristics.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the apparatus and methods as claimed and combinations thereof.

In accordance with one aspect of the present disclosure, a spray nozzle is installed in an attemperator including a steam transfer pipe through which steam is transferred, and a fixed pipe is fixed on an outer surface of the steam transfer pipe, the spray nozzle being configured to spray cooling water into the steam transfer pipe, wherein the spray nozzle is inserted into and fixed in the fixed pipe, and comprises, on an outer circumferential surface thereof, at least one support protruding toward the fixed pipe, and wherein the support is configured to space the spray nozzle and the fixed pipe apart from each other.

An end of the support and an inner surface of the fixed pipe may be spaced apart from each other.

The support may be disposed inside the outer circumferential surface of the steam transfer pipe.

The support may be formed to protrude in a ring shape from the outer circumferential surface of the spray nozzle.

The spray nozzle may further include: a protrusion formed to protrude from an outer circumferential surface of the support.

The protrusion may include a plurality of protrusions arranged on the outer circumferential surface of the support at positions spaced apart from each other.

The support may include a plurality of supports arranged along the outer circumferential surface of the spray nozzle at positions spaced apart from each other.

A junction between the support part and the spray nozzle may have a round shape.

The support may include a tapered part disposed in a longitudinal direction of the spray nozzle.

A radial end of the tapered part may be disposed radially outside the outer circumferential surface of the steam transfer pipe.

The spray nozzle may further include: a damper provided on the support and mounted so as to be slidable in a radial direction of the support; and an elastic unit interposed between the support and the damper.

In accordance with another aspect of the present disclosure, an attemperator includes: a steam transfer pipe through which steam is transferred; a fixed pipe fixed to an outer surface of the steam transfer pipe; a spray nozzle inserted into the fixed pipe and configured to spray cooling water into the steam transfer pipe; and a nozzle fixing member disposed at a position spaced apart from the fixed pipe and configured to support a free end of the spray nozzle, wherein the spray nozzle comprises, on an outer circumferential surface thereof, at least one support, and the support is configured to space the spray nozzle and the fixed pipe apart from each other.

The nozzle fixing member may be aligned with the fixed pipe, and the free end of the spray nozzle may be inserted into the nozzle fixing member.

A stop protrusion may be provided on an inner surface of the fixed pipe, and a seating part may be provided on the outer circumferential surface of the spray nozzle and supported on a surface of the stop protrusion.

The nozzle fixing member may be inserted into and fixed to the steam transfer pipe.

The nozzle fixing member may be threadedly coupled with the spray nozzle.

A second support may be provided in the nozzle fixing member and formed to protrude toward the spray nozzle.

It is to be understood that both the foregoing general description and the following detailed description are exemplary and explanatory and are intended to provide further explanation of the claims.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
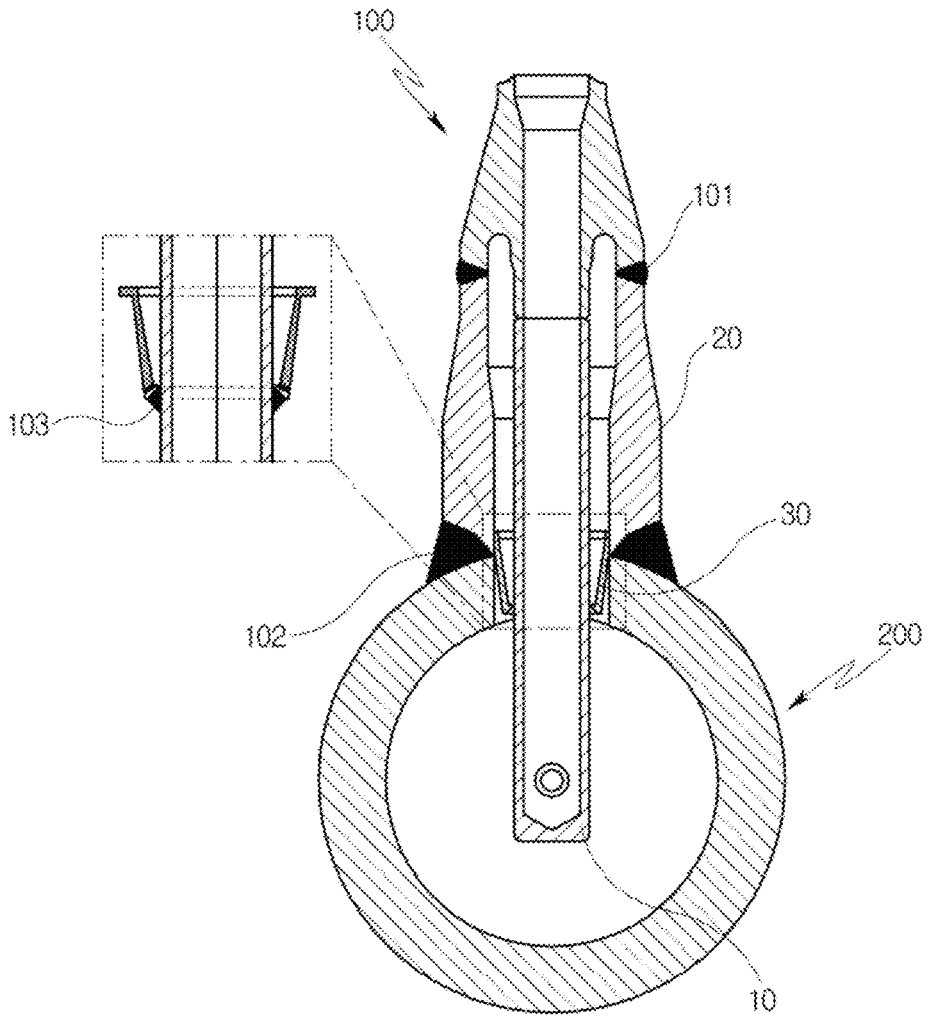
FIG. 1 is a sectional view illustrating the shape of a spray nozzle for an attemperator.

The following description and drawings illustrate exemplary embodiments of the present disclosure. It will be understood by one of ordinary skill in the art that a variety of equivalents and modifications of the embodiments exist.

Embodiments of the present disclosure are described in detail below with reference to the accompanying drawings.

In the drawings, the width, length, thickness, etc. of each element may have been enlarged for convenience. Furthermore, when it is described that one element is disposed 'over' or 'on' the other element, one element may be disposed 'right over' or 'right on' the other element or a third element may be disposed between the two elements. The same reference numbers are used throughout the specification to refer to the same or like parts.

Figure 2:
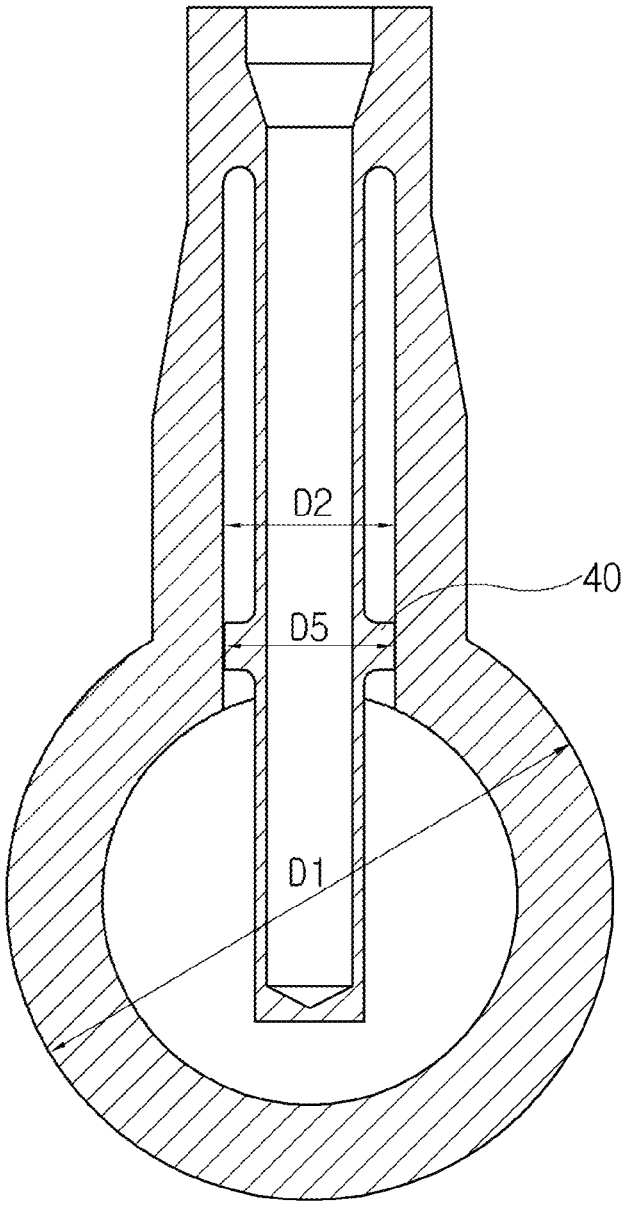
FIG. 2 is a sectional view illustrating an attemperator provided with an embodiment of a spray nozzle according to the present disclosure.

FIG. 2 is a sectional view illustrating an attemperator provided with a spray nozzle according to an embodiment of the present disclosure. In detail, the attemperator includes a steam transfer pipe 200 through which steam is transferred, a fixed pipe 20 which is fixed to and installed on an outer surface of the steam transfer pipe 200, and a spray nozzle 10 which is coupled to the fixed pipe 20 and disposed inside the steam transfer pipe 200 and sprays cooling water into the steam transfer pipe 200. The spray nozzle 10 includes a support 40 which radially protrudes from an outer surface of the spray nozzle 10 toward an inner surface of the fixed pipe 20.

In this regard, an end of the support 40 may be formed such that it is spaced apart from the inner surface of the fixed pipe 20. That is, when an inner diameter of the fixed pipe 20 refers to D2, and a diameter of the support 40 refers to D5, the support 40 may be formed such that D2 is greater than D5. A gap (G) between the end of the support 40 and the inner surface of the fixed pipe 20 refers to (D2−D5)/2, and the effect of reducing vibration to be applied to the spray nozzle may be changed depending on the gap.

Figure 3A:
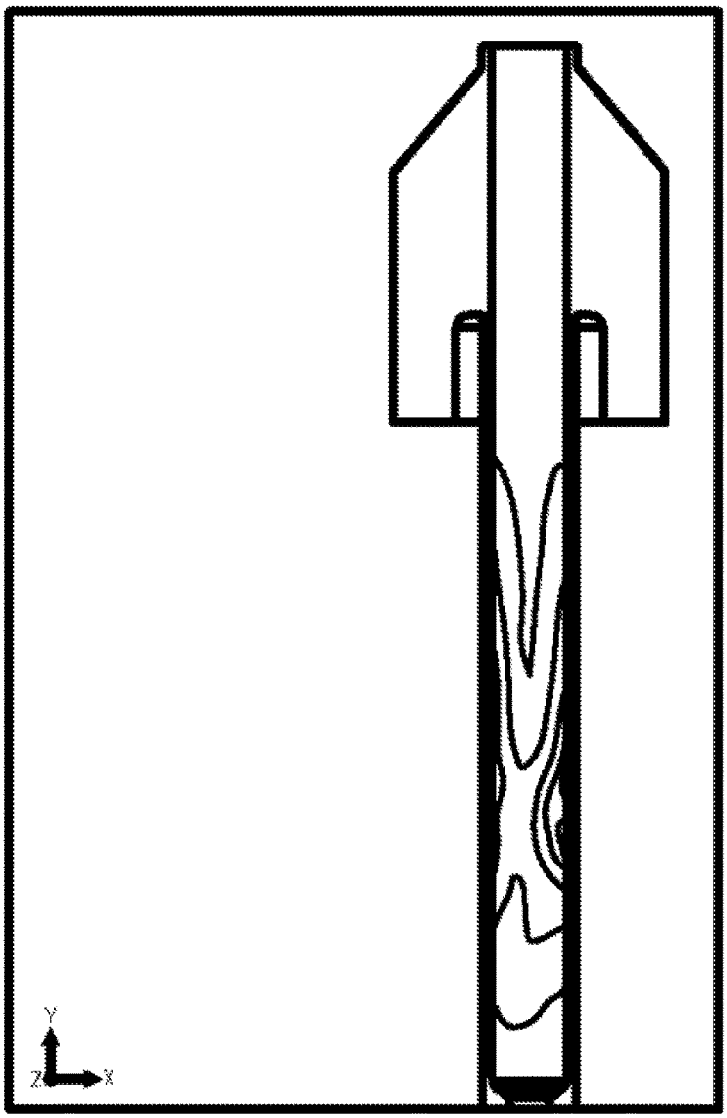
FIG. 3A is diagram showing a stress distribution depending on a distance between the spray nozzle and a fixed pipe according to the embodiment of FIG. 2.
Figure 3B:
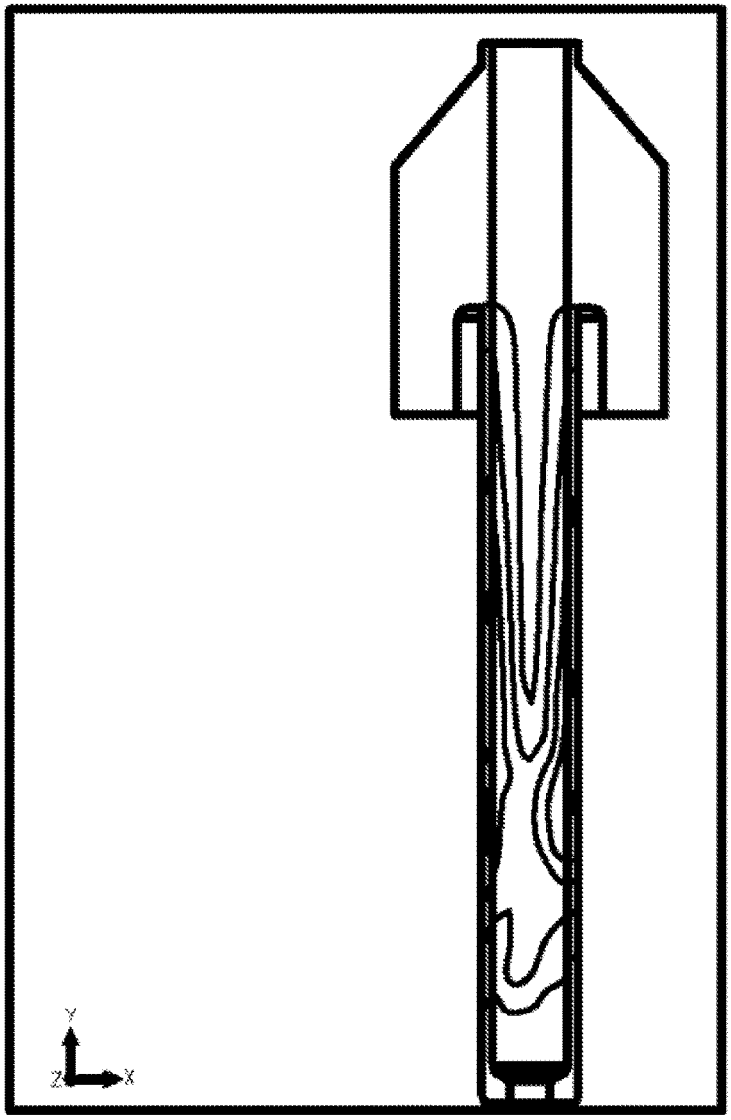
FIG. 3B is diagram showing a stress distribution depending on a distance between the spray nozzle and a fixed pipe according to the embodiment of FIG. 2
Figure 3C:
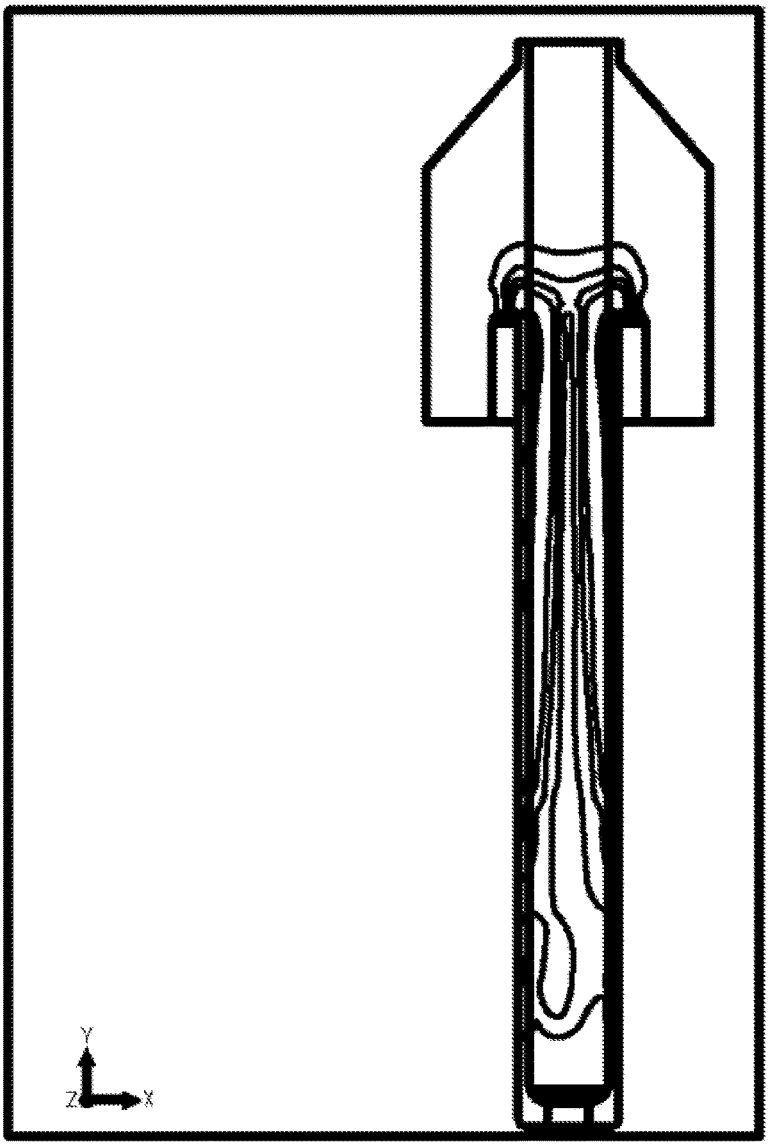
FIG. 3C is diagram showing a stress distribution depending on a distance between the spray nozzle and a fixed pipe according to the embodiment of FIG. 2

Given this, the inventors of the present disclosure have found a change in stress distribution depending on the gap, and the result thereof is shown in FIG. 3. FIG. 3A shows the result of stress analysis when G=0.1 mm, FIG. 3B shows the result when G=0.2 mm, and FIG. 3C shows the result when G=0.5 mm. When G=0.1 mm or 0.2 mm, contact between an inner surface of the fixed pipe or a coupling part of the steam transfer pipe and the support is made on a lower portion of the nozzle by vibration. The maximum stress is generated on the contact portion. The magnitude of the maximum stress was 26 MPa when G=0.1 mm, and was 72 Mpa when G=0.2 mm. When G=0.5 mm, contact between the support and the fixed pipe due to vibration is not made. In this case, the maximum stress is generated on a fixed part of an upper end of the nozzle. The magnitude of the maximum stress was 121 Mpa, which exceeds 94 MPa that is the allowable stress of the nozzle.

Therefore, it is preferable that the gap be set at approximately 0.2 mm. However, since the spray nozzle for the attemperator has various sizes depending on the purpose of use, it is noted that the gap may be set based on a result of a test for the corresponding size.

Figure 4:
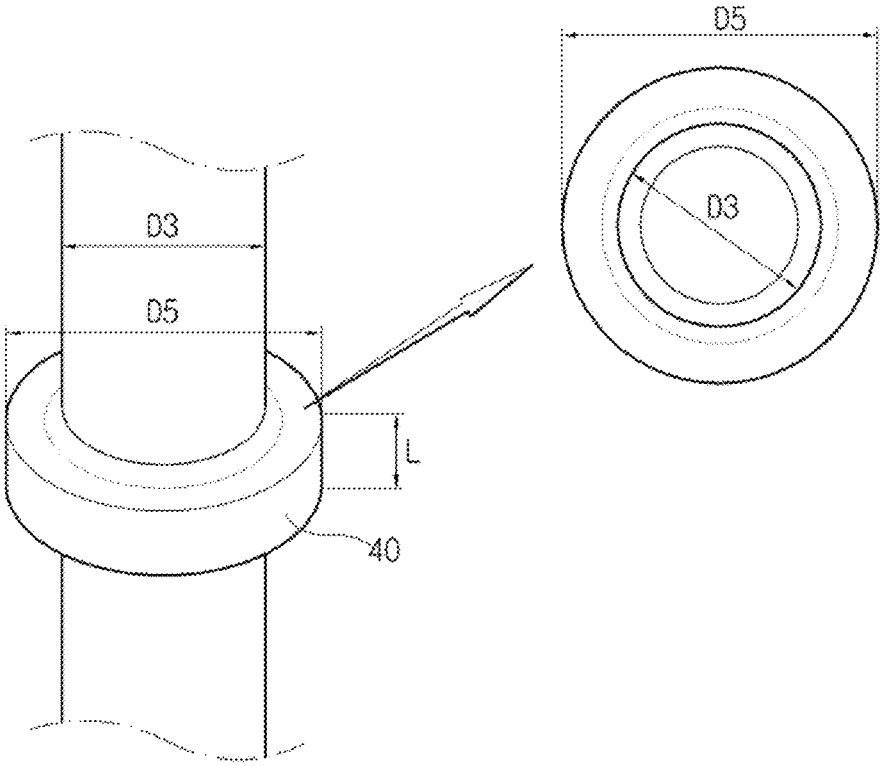
FIG. 4 is a perspective view with a top-down call out view illustrating the embodiment shown in FIG. 2.

Referring to FIGS. 2 and 4, the support 40 is disposed between the center and outer circumferential surface of the steam transfer pipe. A rounded part R is formed between the support 40 and the spray nozzle 10, whereby stress concentration can be reduced or prevented from being caused on the junction between the support 40 and the spray nozzle 10.

In this regard, the position of the support 40 may be arbitrarily set, but if the support 40 is disposed outside the outer circumferential surface of the steam transfer pipe 200 with respect to the radial direction, the length between the support 40 and a free end of the spray nozzle 10 is increased, so that force applied to the spray nozzle 10 by the flow of fluid is increased. Thereby, the effect of the support 40 of reducing the stress of the spray nozzle 10 may be reduced. Hence, it is preferable that the support 40 be disposed as close to the center of the steam transfer pipe 200 as possible. Nevertheless, the support 40 preferably does not protrude into the steam transfer pipe 200 and make contact with steam that is transferred through the steam transfer pipe 200.

The support 40 may have a ring shape in which it protrudes from the spray nozzle 10. In detail, as shown in FIG. 4, the support 40 may have a shape in which it radially protrudes from the outer circumferential surface of the spray nozzle 10 and has a thickness of L with respect to an up-down direction. In this regard, the diameter D5 of the support 40 is determined by the gap G, and if the thickness L is 40 mm or more, it is advantageous in reducing the stress applied to the spray nozzle below the allowable stress.

Figure 5:
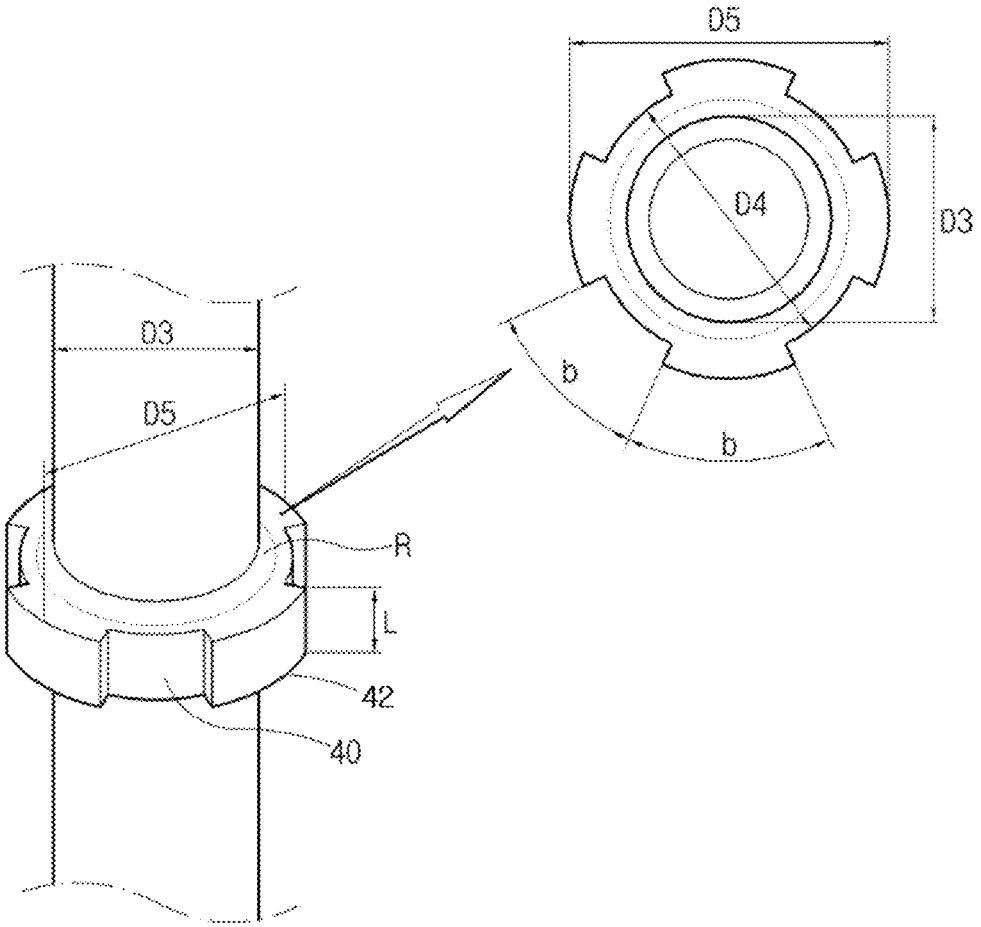
FIG. 5 is a perspective view with a top-down call out view illustrating a modification example of the embodiment shown in FIG. 2.

The support 40 may be modified in various shapes. Referring to FIG. 5, the support part 40 may have a structure with additional protrusions 42 provided on the outer surface thereof. In this case, the diameter of the support 40 is denoted by "D4", and "D5" described in the embodiment shown in FIG. 4 is replaced with the diameter of a circle defined by outer ends of the protrusions 42.

As shown in the drawing, the protrusions 42 may be preferably arranged at intervals of 90°. Alternatively, the protrusions 42 may be irregularly arranged at arbitrary intervals, and an example in which the number of protrusions 42 is greater or less than four may also fall within the bounds of the present disclosure.

Figure 6:
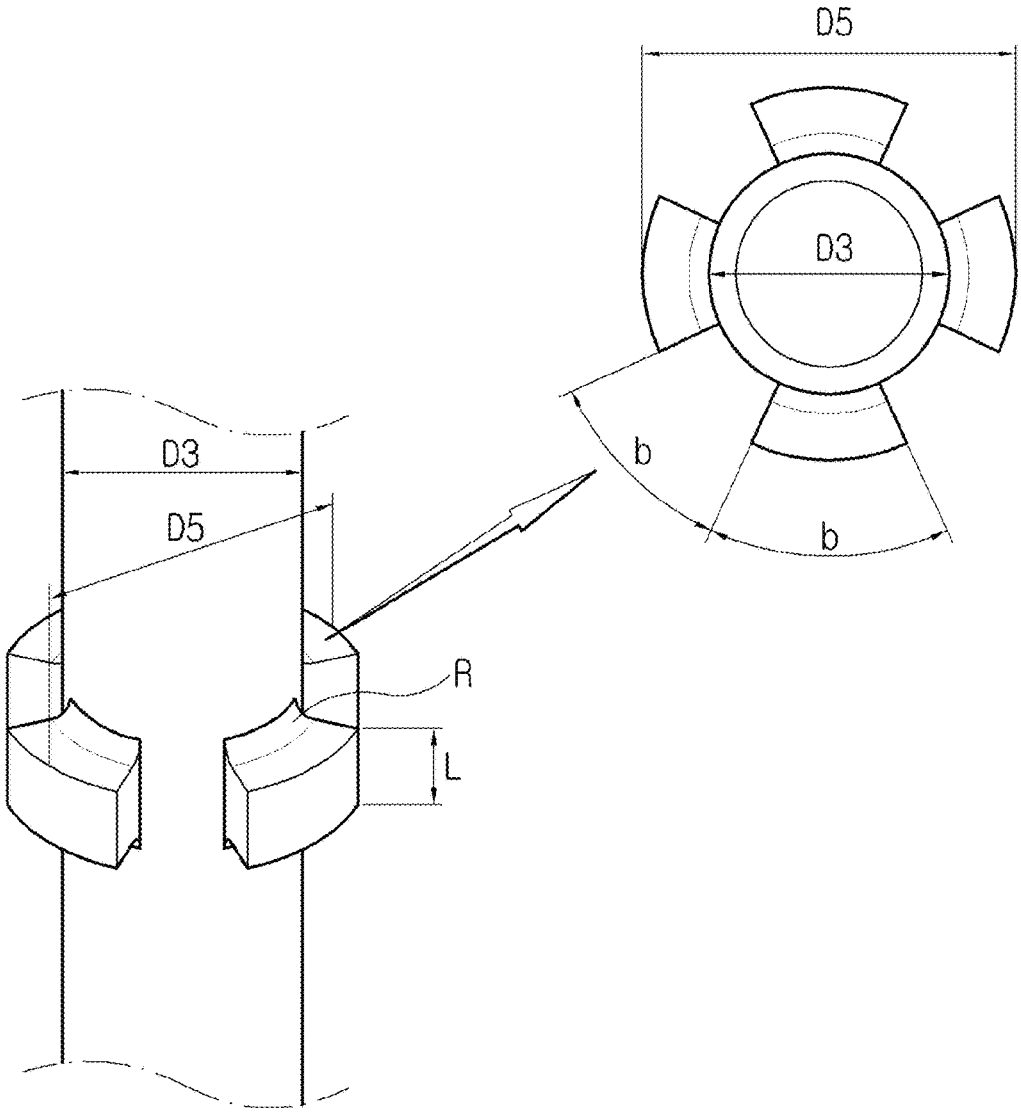
FIG. 6 is a perspective view with a top down call out view illustrating another modification example of the embodiment shown in FIG. 2.

In addition, the support 40 may be formed to have a shape shown in FIG. 6. Referring to FIG. 6, the support 40 may comprise a plurality of supports which are provided on the outer surface of the spray nozzle 10 at positions spaced apart from each other in a circumferential direction at regular intervals. In this case, the number of the supports and the distance therebetween may be arbitrarily set.

Figure 7:
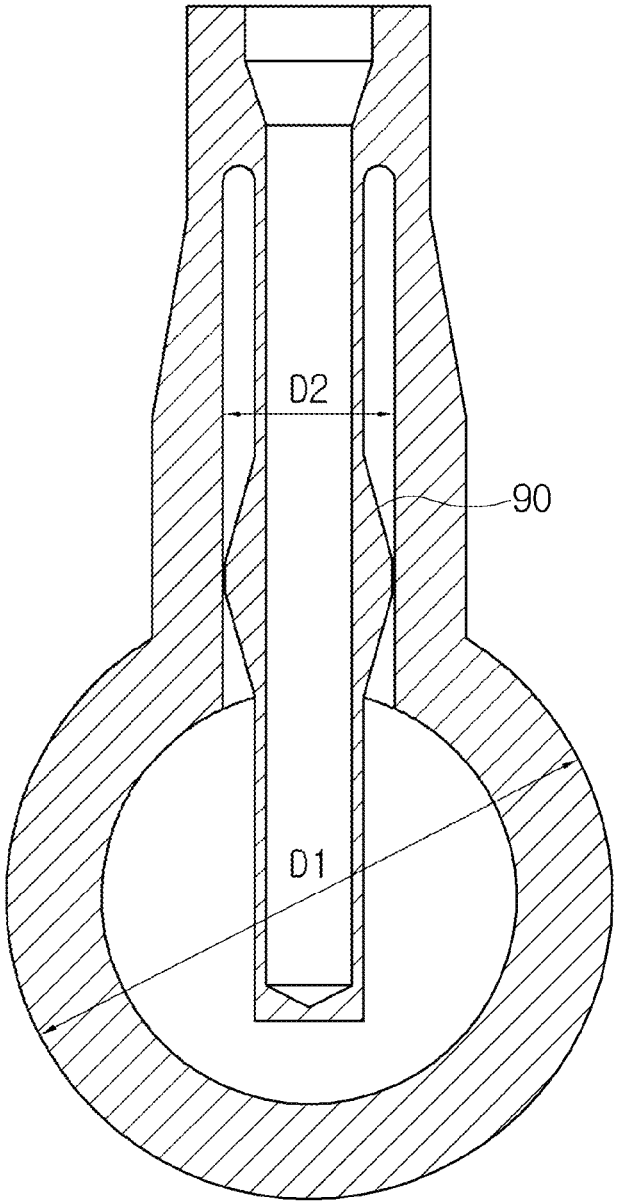
FIG. 7 is a sectional view illustrating an attemperator provided with another embodiment of a spray nozzle according to the present disclosure.
Figure 8:
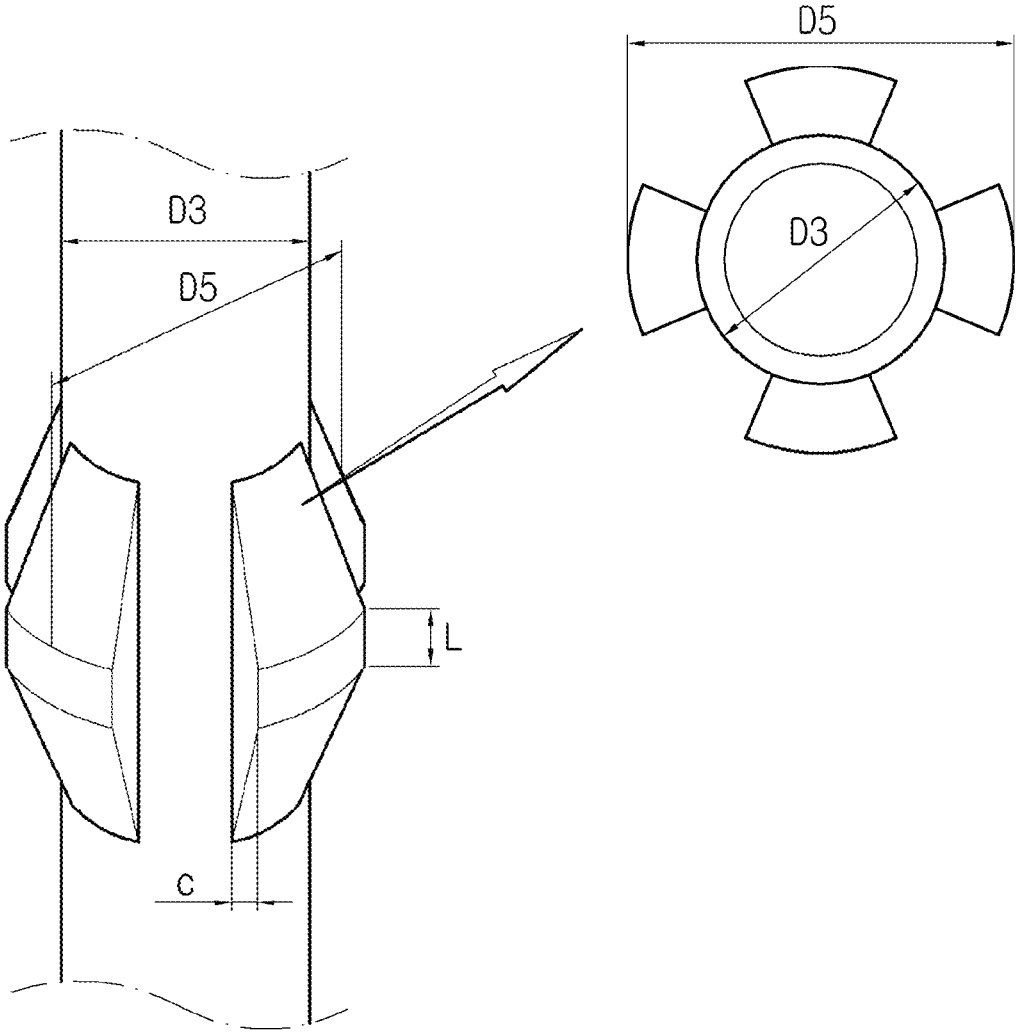
FIG. 8 is a perspective view with a top down call out view illustrating a modification example of the embodiment shown in FIG. 7.

Referring to FIGS. 7 and 8, the support 40 may be formed such that tapered parts 90 are provided in the longitudinal direction of the spray nozzle 10 on respective opposite side surfaces of the support 40. That is, the support 40 may have a shape in which the protruding height thereof is increased along a tapered part 90 and then reduced again along the other tapered part 90. In this case, it can be understood that the support 40 is disposed outside the outer circumferential surface of the steam transfer pipe 200 with respect to the radial direction, unlike that of the embodiment shown in FIG. 2.

Generally, to couple the fixed pipe 20 to the steam transfer pipe 200, a hole corresponding to the inner diameter of the fixed pipe 20 is formed in the outer surface of the steam transfer pipe 200. Thereafter, the fixed pipe 20 is disposed on the hole and fixed to the outer surface of the steam transfer pipe 200 by a method such as welding. Here, it is highly possible that back bead of a weld 102 is formed inside the fixed pipe 20. In the case where the back bead is formed inside the fixed pipe 20, when an assembly process of inserting the spray nozzle 10 into the steam transfer pipe 200 is performed, interference is caused by the back bead. In this case, an additional inner diameter machining process for removing the back bead is required.

However, as shown in FIG. 7, if the support 40 along with the tapered parts 90 is disposed outside the steam transfer pipe 200, the portion of the support 40 that corresponds to the maximum diameter D5 is disposed outside the outer diameter D1 of the steam transfer pipe 200. Consequently, during the assembly process, there is no influence resulting from the back bead. However, in the case where, as described in the first embodiment, the support 40 is disposed on the portion of the steam transfer pipe 200 that corresponds to the outer diameter D1, concentration stress may be caused on the junction between the support 40 and the spray nozzle 10. The concentration stress may exceed the allowable stress. Therefore, to overcome this problem, it is preferable that the tapered parts 90 be formed to reinforce the area of a portion between the support 40 and the spray nozzle 10 that is vulnerable to stress.

The tapered parts 90 may not only reduce stress concentration but may also provide effect of reducing a bending phenomenon due to vibration of the spray nozzle 10.

In this regard, as shown in FIG. 8, a plurality of supports 40 along with a plurality of tapered parts 90 may be arranged in the circumferential direction. Alternatively, as shown in FIG. 4, the single support 40 provided with the tapered parts 90 may be formed to have a ring shape.

Figure 9:
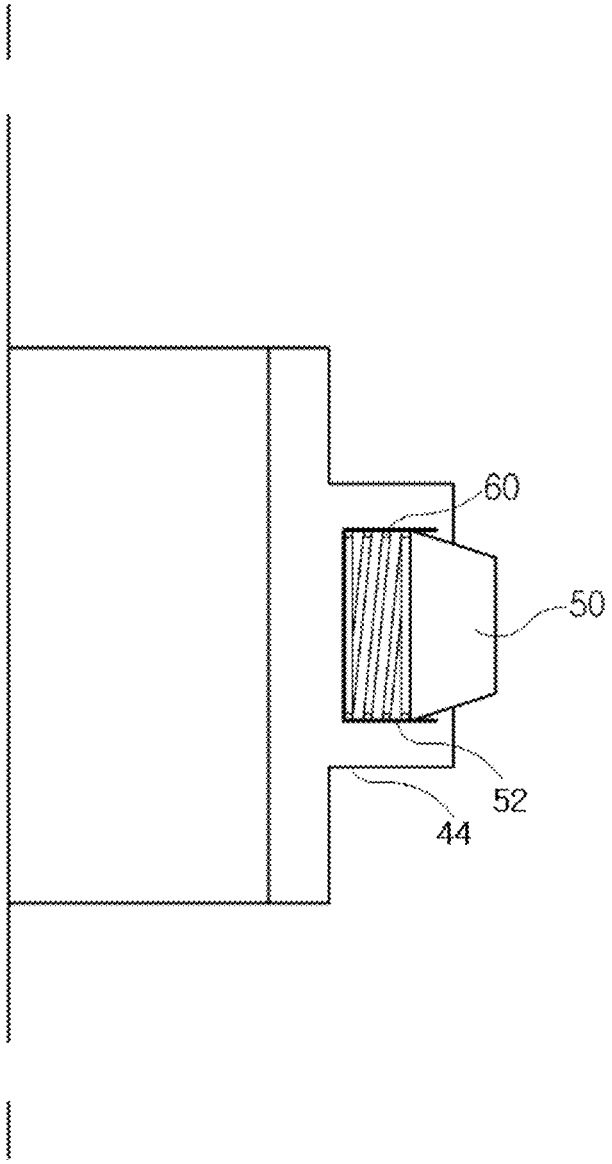
FIG. 9 is a sectional view illustrating another modification example of the embodiment shown in FIG. 7.

As shown in FIG. 9, an example may be considered, in which a damper 50 is provided in the outer circumferential surface of the support part 40. The damper 50 is configured such that it comes into contact with the inner circumferential surface of the fixed pipe 20 and can absorb vibrations. A rear surface of the damper 50 is supported by an elastic means such as a coil spring 52. To fix the coil spring 52 and the damper 50, a damper support unit 44 is provided in the end of the support 40.

Due to the elastic force of the coil spring 52, the damper 50 can be constantly maintained in a state in which it makes contact with the inner surface of the fixed pipe 20. Therefore, even if vibration is caused, the coil spring 52 may compressed and expanded, thus absorbing the vibration. As a result, stress caused by direct contact between the support 40 and the fixed pipe 20 can be mitigated.

Figure 10:
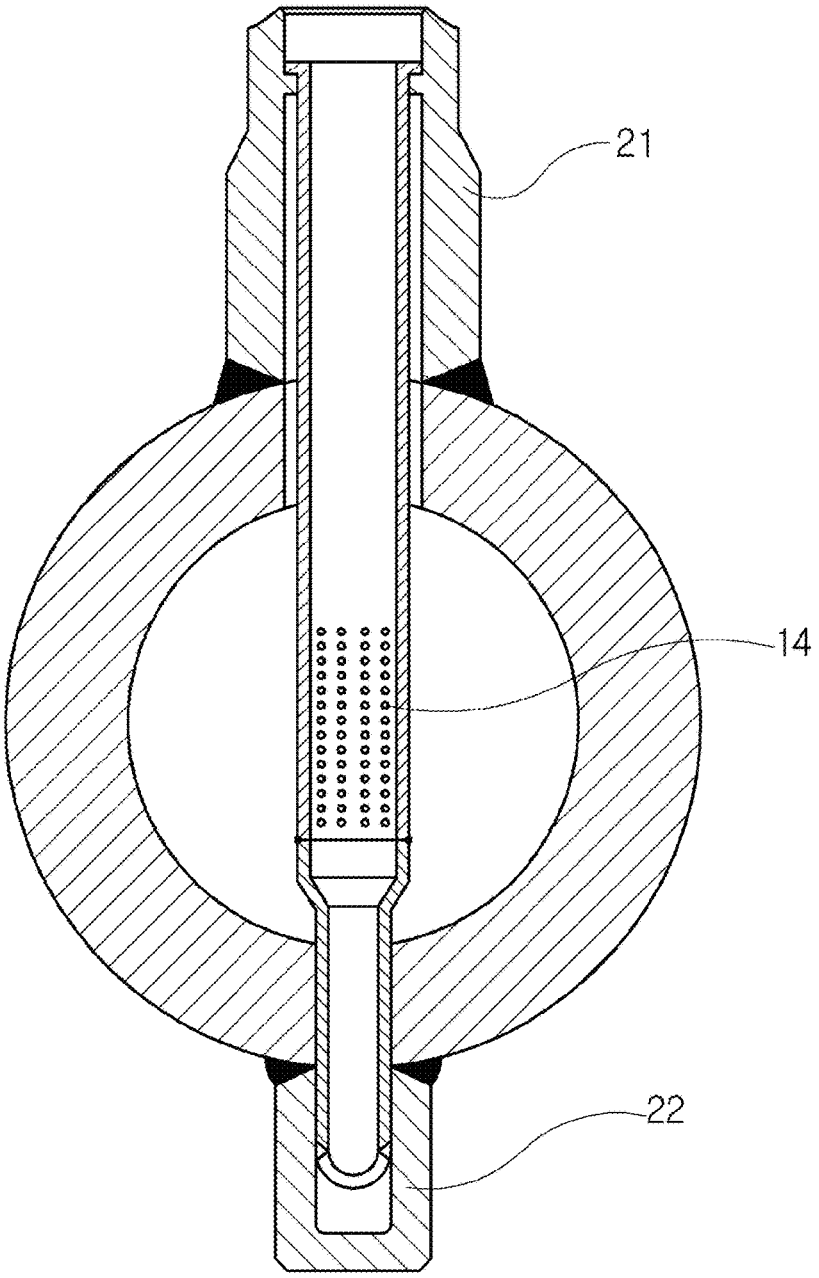
FIG. 10 is a sectional view illustrating an embodiment of an attemperator according to the present invention.

Referring to FIG. 10, there is illustrated another embodiment of the attemperator according to the present disclosure. Referring to FIG. 10, the attemperator includes a steam transfer pipe 200 having the same structure as that shown in FIG. 1. A fixed pipe 21 is mounted on a predetermined portion of the steam transfer pipe 200. In common with the embodiment of FIG. 2, the fixed pipe 21 functions to fix the spray nozzle 10 inserted thereinto. The spray nozzle 10 may have the same structure as that of any one of the above-described embodiments and modifications.

In this embodiment, a free end 12 of the spray nozzle 10 has a length sufficient to protrude out of the steam transfer pipe 200. A nozzle fixing member 22 is welded to the outer surface of the steam transfer pipe 200 so as to fix the protruded free end 12. The fixed pipe 21 and the nozzle fixing member 22 are disposed on an approximately linear line so that the spray nozzle 10 can be supported on at least two portions.

Figure 13:
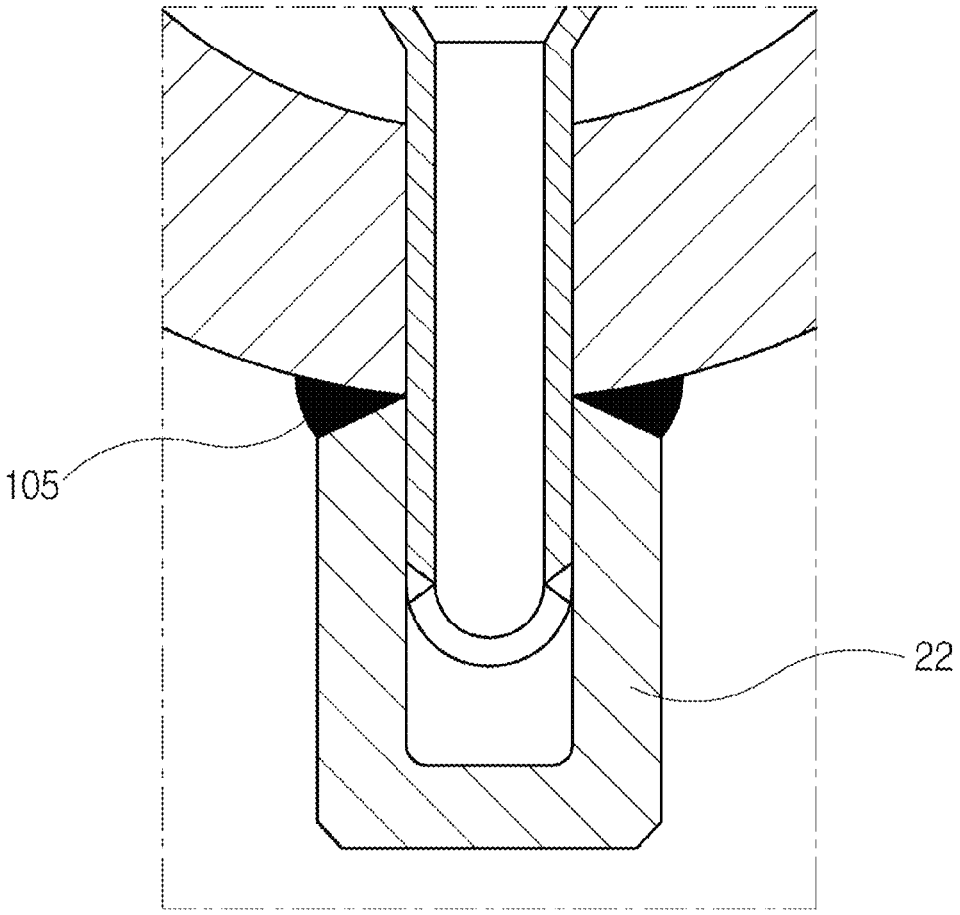
FIG. 13 is a sectional view illustrating an enlargement of a portion of FIG. 10.

In detail, as also shown in FIG. 13, the nozzle fixing member 22 has a cylindrical structure having an internal space into which the free end 12 of the spray nozzle 10 is inserted such that the free end 12 is fixed to the nozzle fixing member 22. The internal space is formed to have a diameter slightly greater than the outer diameter of the free end 12 of the spray nozzle 120.

Furthermore, an upper end of the spray nozzle 10 is welded to the fixed pipe 21. In this way, since the spray nozzle 10 is fixed at the upper and lower ends thereof, the natural frequency of the spray nozzle 10 is increased to more than three times that of otherwise spray nozzle structures. Therefore, the nozzle may be effectively prevented from being damaged by vibration.

Figure 11:
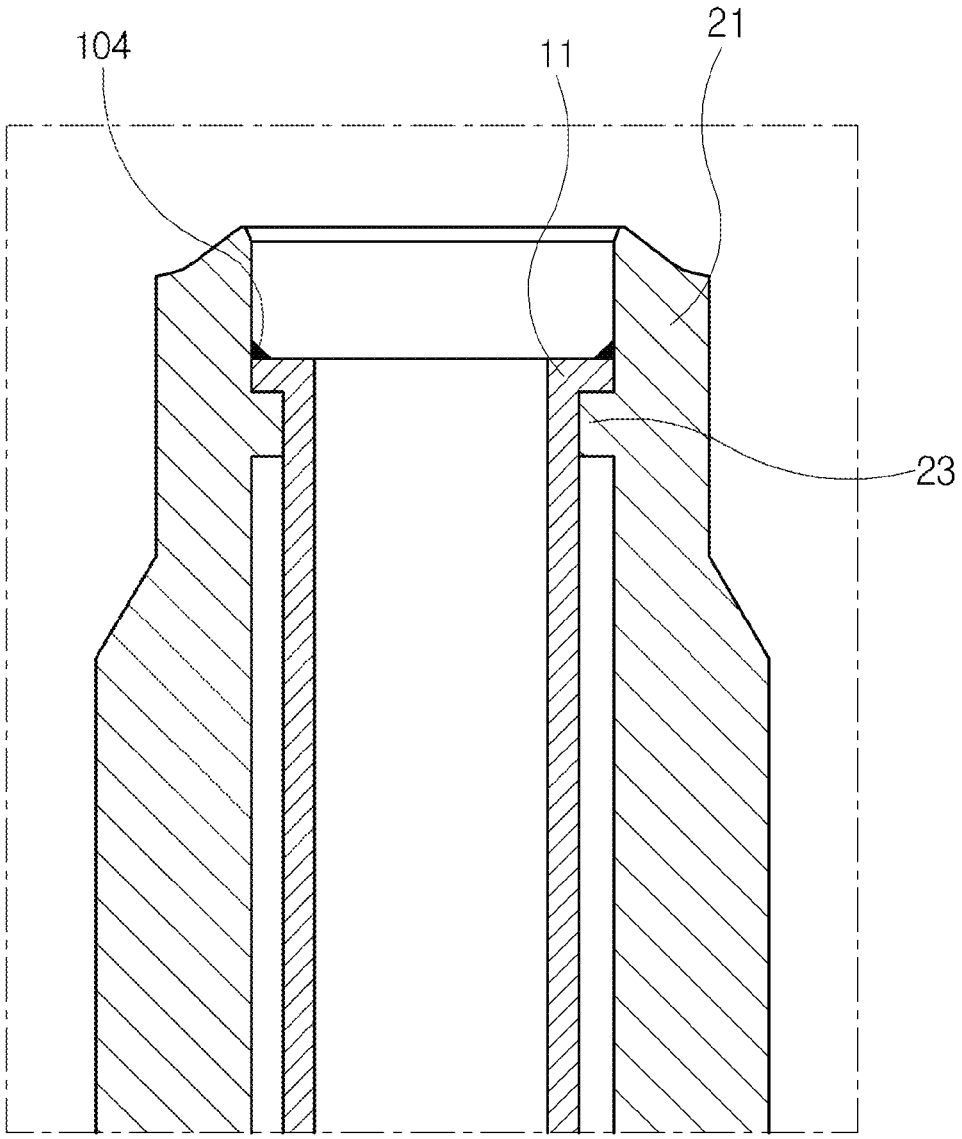
FIG. 11 is a sectional view illustrating an enlargement of a portion of FIG. 10.

FIG. 11 is a sectional view showing an enlargement of the upper end of the spray nozzle 10. An annular stop protrusion 23 is provided on an inner surface of the fixed pipe 21. Corresponding to the stop protrusion 23, a seating part 11 is provided on the upper end of the spray nozzle 10. In this regard, the outer diameter of the seating part 11 is greater than the inner diameter of the stop protrusion 23, so that when the spray nozzle 10 is inserted into the fixed pipe 21, the seating part 11 is supported on the stop protrusion 23, whereby the spray nozzle 10 can be disposed at the correct position in the fixed pipe 21. Thereafter, a weld 104 is formed between the seating part 11 and the inner surface of the fixed pipe 21, whereby the spray nozzle 10 can be stably fixed in place.

This structure is advantageous for maintenance work. That is, when it is required to separate the spray nozzle 10 from the fixed pipe 21 so as to perform maintenance work later, it can be easily separated therefrom only by removing the weld formed between the spray nozzle 10 and the inner surface of the fixed pipe 21 through a machining process. Because the weld is small compared to that of the conventional art, and a portion to be removed through the machining process is very small, the fixed pipe 21 and the spray nozzle 10 can be reused.

Figure 12:
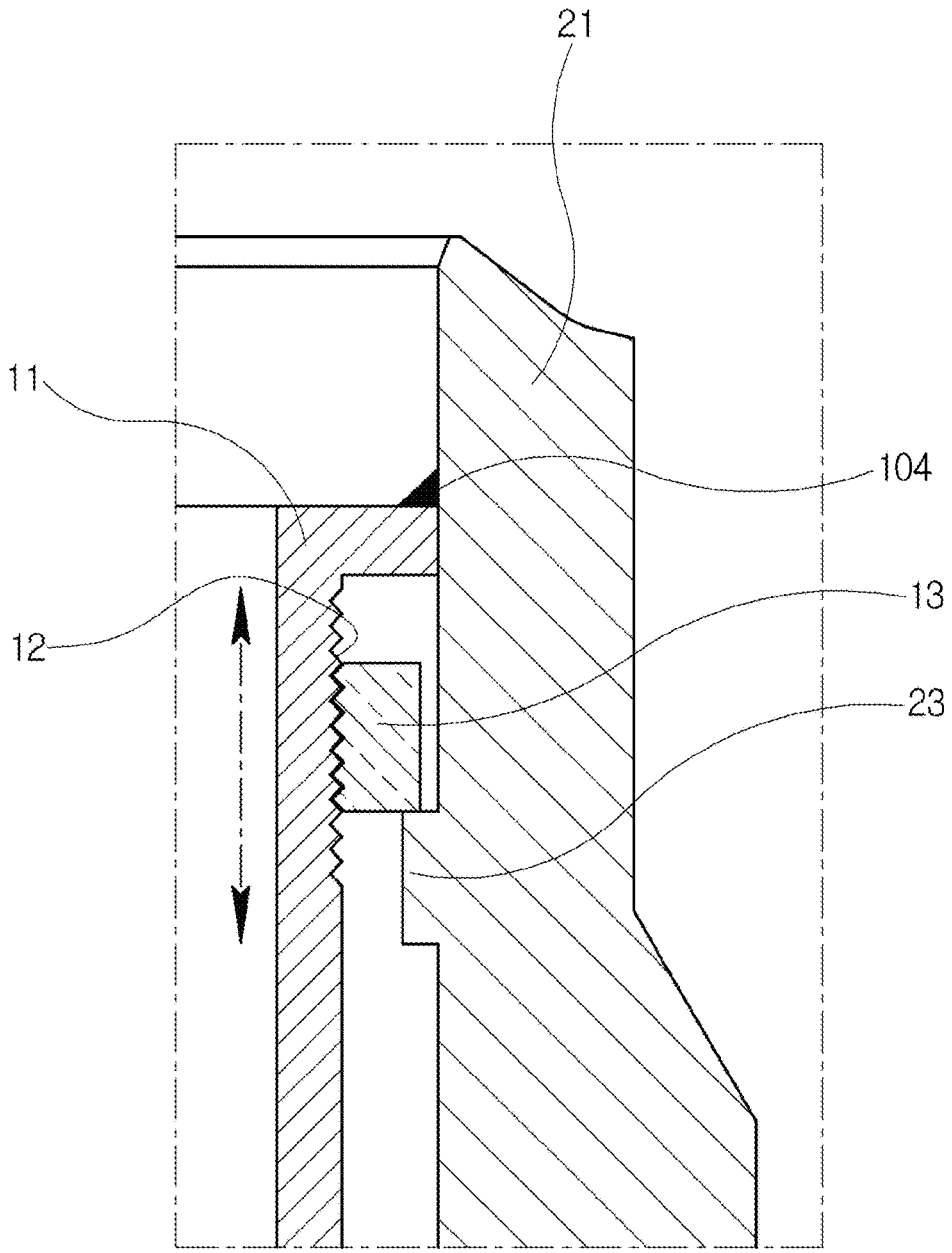
FIG. 12 is a sectional view illustrating a modification example of the embodiment of FIG. 10.

The spray nozzle 10 is configured such that cooling water is discharged through a spray hole to control the temperature of overheated steam. It is preferable that the spray hole is disposed in the central portion of the vertical cross-section of the steam transfer pipe 200. Therefore, the depth to which the spray nozzle 10 is inserted into the steam transfer pipe 200 may be adjusted. For this, as shown in FIG. 12, an example may be considered, in which a threaded part 12 is formed on the spray nozzle 10 under the seating part 11, and a height adjustment ring 13 coupled to the threaded part 12 is additionally provided. The height adjustment ring 13 is movable along the threaded part 12 upward or downward and is disposed on the stop protrusion 23 so that the depth to which the spray nozzle 10 is inserted can be adjusted.

As shown in FIG. 13, the lower end of the spray nozzle 10 is supported by the nozzle fixing member 22. In this regard, because the length of the spray nozzle 10 may be varied by thermal expansion under high-temperature conditions, the nozzle fixing member 22 is configured such that the lower end of the spray nozzle 10 is spaced apart from the inner surface of the nozzle fixing member 22 so as to allow the spray nozzle 10 to slide in the nozzle fixing member 22.

Figure 14:
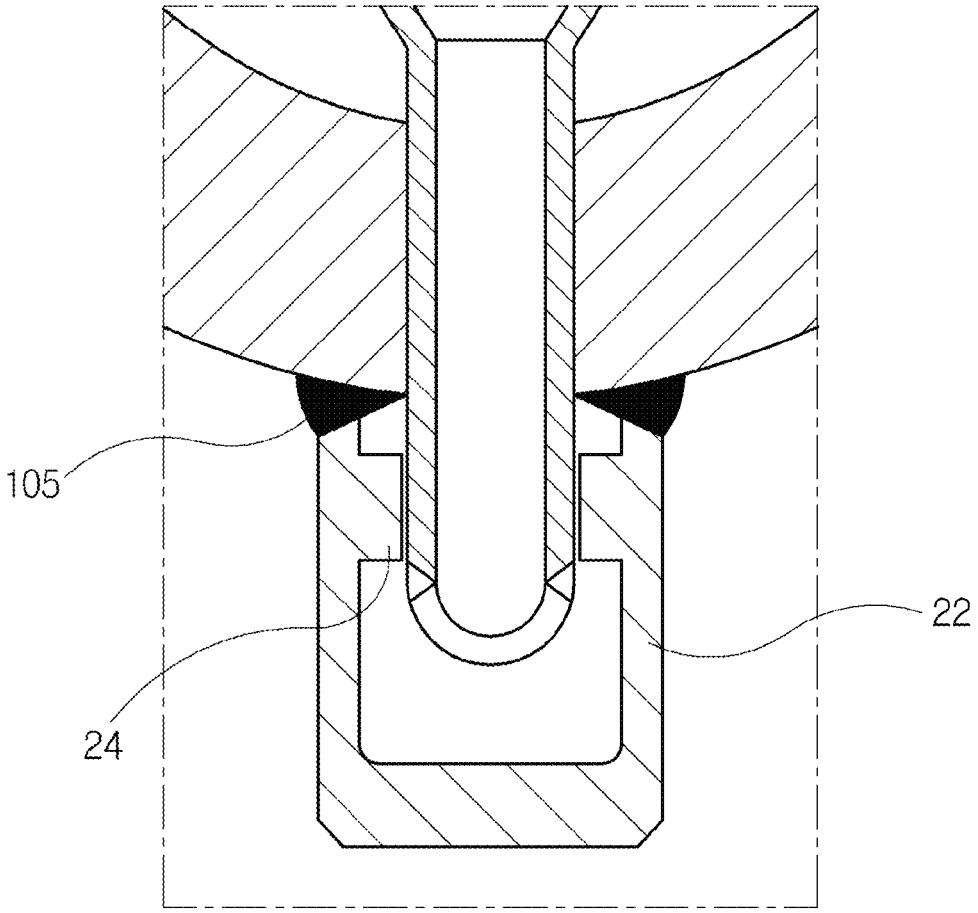
FIG. 14 is a sectional view illustrating another modification example of the embodiment of FIG. 10.
Figure 15:
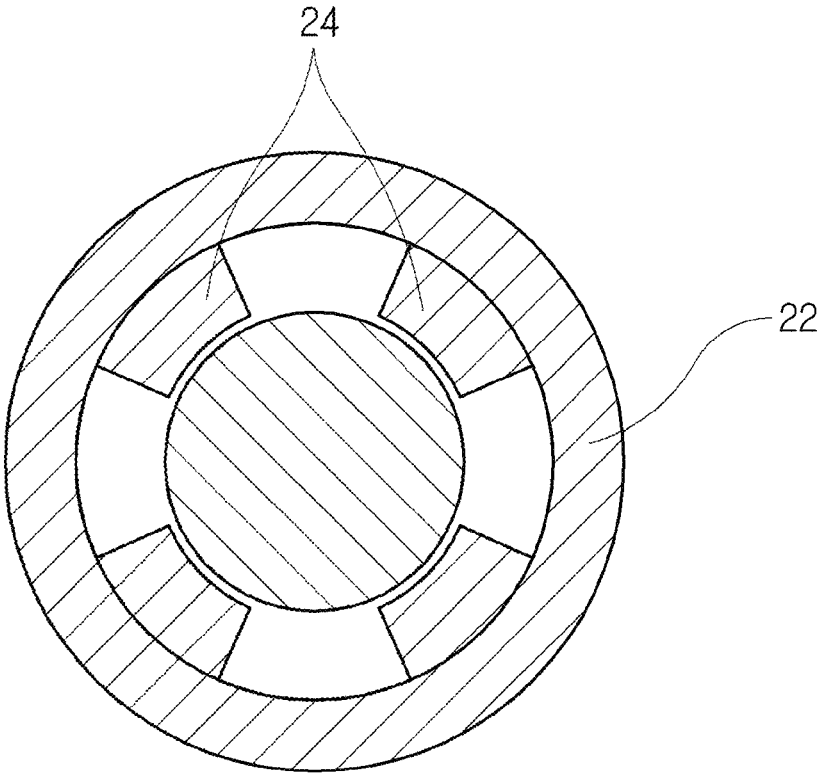
FIG. 15 is a sectional view illustrating the modification example shown in FIG. 14.

To make the slide movement of the spray nozzle 10 more reliable, as shown in FIGS. 14 and 15, an example may be considered, in which one or more second supports 24 each having a protrusion form are provided on the inner surface of the nozzle fixing member 22. In this regard, a surface of each second support 24 that faces the spray nozzle 10 may have a shape corresponding to the shape of the outer surface of the spray nozzle 10. For example, if the lower end of the spray nozzle 10 has a circular shape, the facing surface of the second support 24 may have a concave-arc shape. If the lower end of the spray nozzle 10 has a planar shape, the facing surface of the second support 24 may also have a planar shape.

Figure 16:
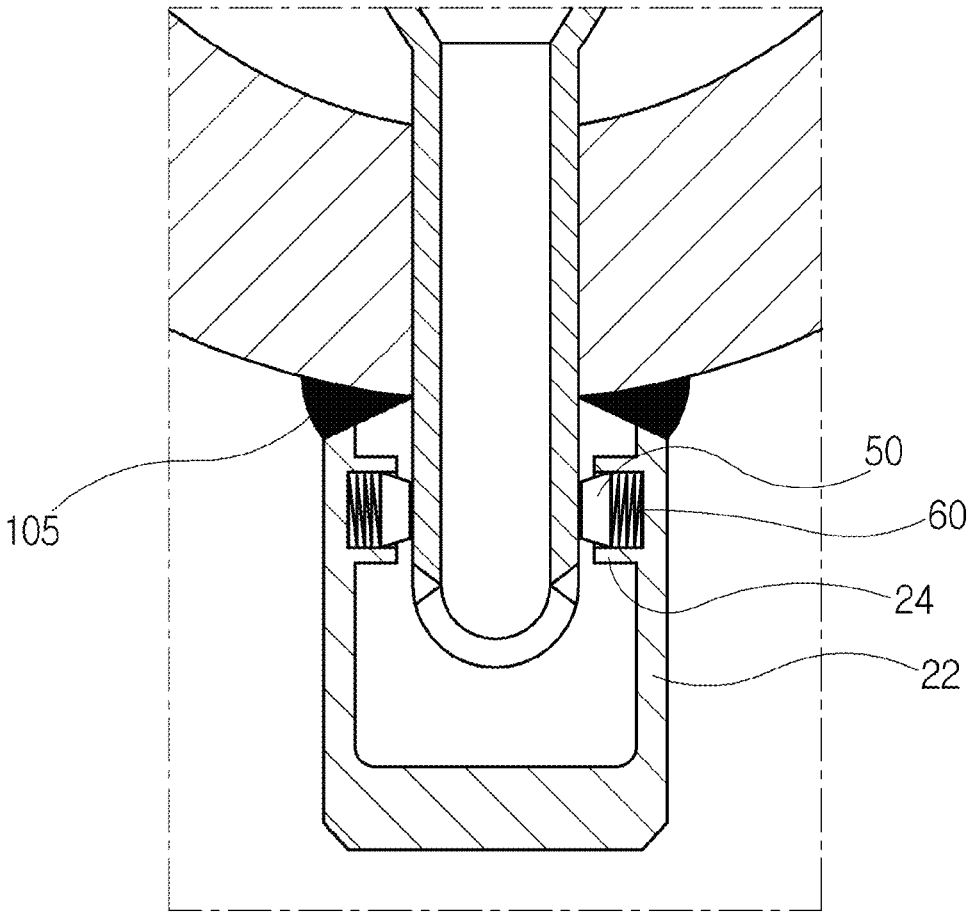
FIG. 16 is a sectional view illustrating yet another modification example of the embodiment of FIG. 10.

In addition, an example may be considered, in which the damper 50 introduced in the embodiment of FIG. 9 is formed in each second support 24. That is, as shown in FIG. 16, the damper 50 with a coil spring 52 may be provided in each second support 24. Thereby, the spray nozzle 10 can be more stably supported.

Although, in all of the above-mentioned examples, the lower end of the spray nozzle 10 has been described as being inserted into and supported by the nozzle fixing member 22, a bolt or the like may be used so as to support the lower end of the spray nozzle 10.

Figure 17:
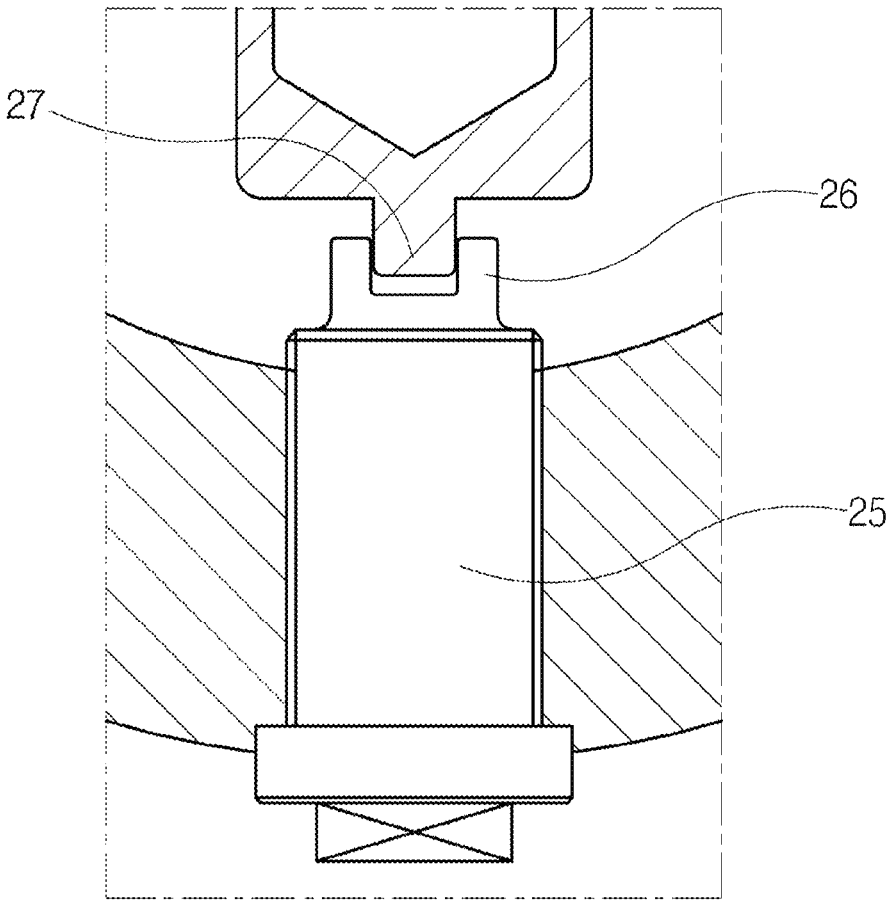
FIG. 17 is a sectional view illustrating still another modification example of the embodiment of FIG. 10.

FIG. 17 is a view illustrating a modification example of the nozzle fixing member. This modification example has a shape in which a bolt coupling 25 in lieu of the nozzle fixing member 22 is inserted into and fixed to the steam transfer pipe 200. The bolt coupling 25 is aligned with the fixed pipe in the same manner as that of the nozzle fixing member 22, and includes a boss 26 which protrudes into the steam transfer pipe 200. A threaded part is formed on the inner surface of the boss 26. A bolt coupling part 27 provided on the lower end of the spray nozzle 10 is coupled to the boss 26 through the threaded part so that the spray nozzle 10 can be supported on two portions.

Figure 18:
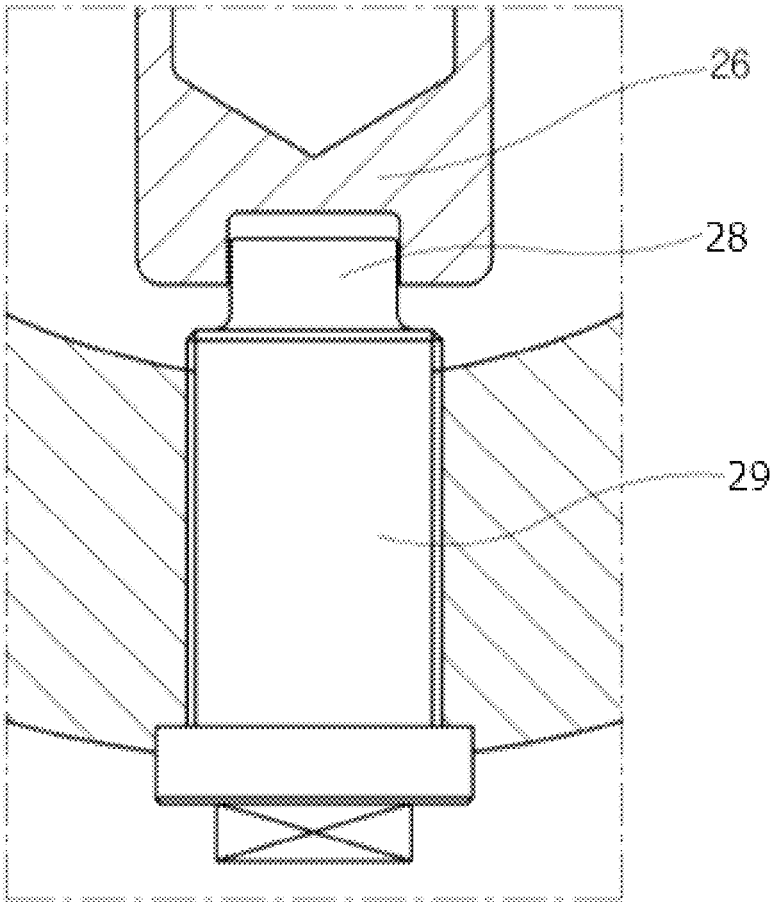
FIG. 18 is a sectional view illustrating still another modification example of the embodiment of FIG. 10.

In this regard, the boss 26 may not be formed on the bolt coupling 25. An example may be considered, in which the boss 26 is formed on the spray nozzle 10. That is, as shown in FIG. 18, an example may be considered, in which a bolt coupling part 28 is formed in the bolt coupling 25, and a boss 29 is provided on the lower end of the spray nozzle 10.

According to aspects of the present disclosure having the above-mentioned configuration, because a force-fitting method is not required for the operation of fixing a spray nozzle, not only can a process of manufacturing an attemperator be facilitated, but maintenance work can also be easily performed.

In addition, vibration to be applied to the spray nozzle can be easily mitigated, whereby concentration stress applied to a coupling portion or the like of the spray nozzle can be effectively reduced. Consequently, the satisfactory structural strength of the spray nozzle can be secured.

While the present disclosure has been described with respect to the specific embodiments, it will be apparent to those skilled in the art that various changes and modifications may be made without departing from the spirit and scope of the following claims.

What is claimed is:

1. A spray nozzle operable to spray cooling water into a steam transfer pipe and installed in an attemperator including the steam transfer pipe, the spray nozzle comprising:

a fixed pipe coupled at a first end to an outer surface of the steam transfer pipe and open at a second end; and a first support protruding from an outer circumferential surface of the spray nozzle toward an inner circumferential surface of the fixed pipe, to space the spray nozzle and the fixed pipe apart from each other, wherein the spray nozzle is disposed in the fixed pipe so as to be coupled to the second end of the fixed pipe and projected through the first end in order to spray the cooling water into the steam transfer pipe by way of the fixed pipe, and the first support has an annular shape including first and second surfaces each of which is parallel to the other and communicates with the outer circumferential surface of the spray nozzle, the first surface being disposed outward radially with respect to a center axis of the steam transfer pipe and residing radially inside the outer surface of the steam transfer pipe, the second surface being disposed inward radially with respect to the first surface and residing radially inside an inner surface of the steam transfer pipe.

2. The spray nozzle according to claim 1, wherein an end of the first support and an inner surface of the fixed pipe are spaced apart from each other.

3. The spray nozzle according to claim 1, further comprising:

a protrusion that protrudes from an outer circumferential surface of the first support.

4. The spray nozzle according to claim 3, wherein the protrusion of the first support includes a plurality of protrusions arranged on the outer circumferential surface of the first support at positions spaced apart from each other.

5. The spray nozzle according to claim 1, wherein the first support is formed as a plurality of supports arranged along the outer circumferential surface of the spray nozzle at positions spaced apart from each other.

6. The spray nozzle according to claim 1, wherein a junction between the first support and the spray nozzle has a round shape.

7. The spray nozzle according to claim 1, further comprising:

a damper coupled to the first support and operable to slide with respect to the first support in a radial direction of the spray nozzle, and an elastic unit disposed between the first support and the damper.

8. The spray nozzle according to claim 1, further comprising:

a nozzle fixing member coupled to the steam transfer pipe at a position spaced apart from the fixed pipe and operable to support a free end of the spray nozzle; and a second support that protrudes from the nozzle fixing member toward the spray nozzle and is disposed radially outside the outer surface of the steam transfer pipe.

9. An attemperator comprising:

a steam transfer pipe operable to transfer steam;

a fixed pipe coupled at a first end to an outer surface of the steam transfer pipe and open at a second end;

a spray nozzle disposed in the fixed pipe so as to be coupled to the second end of the fixed pipe and projected through the first end and operable to spray cooling water into the steam transfer pipe by way of the fixed pipe;

a first support protruding from an outer circumferential surface of the spray nozzle toward an inner circumferential surface of the fixed pipe, to space the spray nozzle and the fixed pipe apart from each other; and a nozzle fixing member disposed at a position spaced apart from the fixed pipe and operable to support a free end of the spray nozzle, wherein the first support has an annular shape including first and second surfaces each of which is parallel to the other and communicates with the outer circumferential surface of the spray nozzle, the first surface being disposed outward radially with respect to a center axis of the steam transfer pipe and residing radially inside the outer surface of the steam transfer pipe, the second surface being disposed inward radially with respect to the first surface and residing radially inside an inner surface of the steam transfer pipe.

10. The attemperator according to claim 9, wherein the nozzle fixing member is aligned with the fixed pipe, and the free end of the spray nozzle is disposed in the nozzle fixing member.

11. The attemperator according to claim 9, wherein the outer circumferential surface of the spray nozzle includes a seat having a flat lower surface that protrudes outward from the spray nozzle and faces the steam transfer pipe, and an inner surface of the fixed pipe includes a stop protrusion having a flat upper surface for receiving the seat of the spray nozzle.

12. The attemperator according to claim 9, wherein the nozzle fixing member is disposed in and coupled to the steam transfer pipe.

13. The attemperator according to claim 12, wherein the nozzle fixing member threadedly couples with the spray nozzle.

14. The attemperator according to claim 9, wherein the nozzle fixing member includes a second support that protrudes toward the spray nozzle.

15. An attemperator comprising:

a steam transfer pipe operable to transfer steam;

a fixed pipe coupled at a first end to an outer surface of the steam transfer pipe and open at a second end;

a spray nozzle disposed in the fixed pipe so as to be coupled to the second end of the fixed pipe and projected through the first end and operable to spray cooling water into the steam transfer pipe by way of the fixed pipe;

a first support protruding from an outer circumferential surface of the spray nozzle toward an inner circumferential surface of the fixed pip; to space the spray nozzle and the fixed pipe apart from each other; and a nozzle fixing member coupled to the steam transfer pipe and operable to support a free end of the spray nozzle, wherein the first support has an annular shape including first and second surfaces each of which is parallel to the other and communicates with the outer circumferential surface of the spray nozzle, the first surface being disposed outward radially with respect to a center axis of the steam transfer pipe and residing radially inside the outer surface of the steam transfer pipe, the second surface being disposed inward radially with respect to the first surface and residing radially inside an inner surface of the steam transfer pipe.

16. The attemperator according to claim 15, wherein the nozzle fixing member is aligned with the fixed pipe, and the free end of the spray nozzle is disposed in the nozzle fixing member.

17. The attemperator according to claim 15, wherein the nozzle fixing member includes a second support that protrudes toward the spray nozzle.

* * * * *